United States Patent [19]

Samuel et al.

[11] Patent Number: 4,848,300

[45] Date of Patent: Jul. 18, 1989

[54] ELECTRONIC CONTROL SYSTEM FOR AN IC ENGINE

[75] Inventors: James J. Samuel, Essington; Albert R. Tingey, Whitacre Heath, Nr. Coleshill, both of England

[73] Assignee: Lucas Industries public limited company, England

[21] Appl. No.: 151,999

[22] Filed: Feb. 3, 1988

[30] Foreign Application Priority Data

Feb. 4, 1987 [GB] United Kingdom ..... 8702460

[51] Int. Cl.[4] ..... F02D 41/14

[52] U.S. Cl. ..... 123/489; 123/440

[58] Field of Search ..... 123/440, 489

[56] References Cited

U.S. PATENT DOCUMENTS

| | | | |
|---|---|---|---|
| 4,177,787 | 12/1979 | Hattori et al. | 123/489 X |
| 4,228,775 | 10/1980 | Schweikert | 123/489 X |
| 4,300,505 | 11/1981 | Takada et al. | 123/489 X |
| 4,402,292 | 9/1983 | Ohgami et al. | 123/489 X |
| 4,461,258 | 7/1984 | Becker et al. | 123/489 X |
| 4,522,180 | 6/1985 | Matsuoka et al. | 123/489 |
| 4,733,358 | 3/1988 | Abthoff et al. | 123/489 X |
| 4,739,740 | 4/1988 | Ohkawara et al. | 123/489 |

FOREIGN PATENT DOCUMENTS 58-79644 5/1983 Japan .

*Primary Examiner*—Tony M. Argenbright
*Attorney, Agent, or Firm*—Nixon & Vanderhye

[57] ABSTRACT

In an engine management system which stores a control value and increments or decrements this according to whether an oxygen sensor in the exhaust system indicates that the engine is running lean or rich and which controls the duration of pulses applied to fuel injectors of the engine according to the stored control value, a compensating adjustment is determined and applied to the pulse length duration in order to maintain the mark/space ratio of the indicating signal from the oxygen sensor at an optimum value. This avoids unacceptable exhaust emissions which might otherwise occur under some conditions.

5 Claims, 2 Drawing Sheets

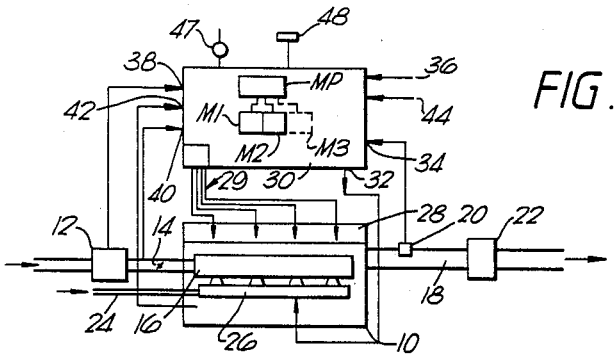
FIG. 1
FIG. 2
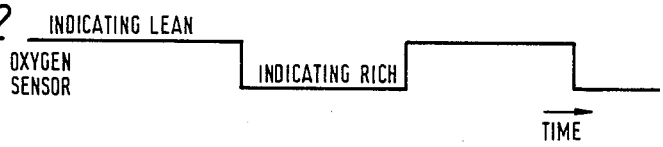
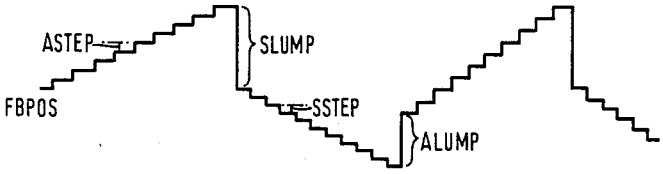
FIG. 3
FIG. 4
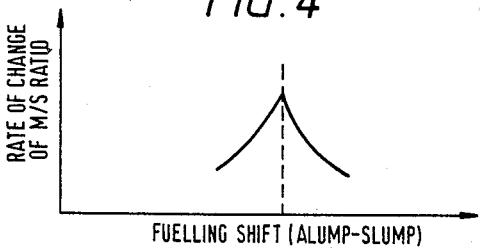

ELECTRONIC CONTROL SYSTEM FOR AN IC ENGINE

This invention relates to an electronic control system for an internal combustion engine, or an engine management system, and is in particular concerned with regulation of the exhaust emission.

Systems are known which exercise a control over the proportions of air and fuel which are fed to the engine, such that the fuelling cycles continuously between lean and rich conditions (with the effect that the exhaust cycles between having a surplus and a deficit of oxygen). A catalyst disposed in the exhaust system serves to ensure that only very low levels of pollutants are emitted into the atmosphere. In order to carry out the control just mentioned, an oxygen sensor is disposed in the exhaust stream just upstream of the catalyst, and provides an electrical voltage the level of which indicates whether the engine is running rich or lean. If the oxygen sensor provides a "rich" indication, then the proportion of fuel is gradually decreased until the sensor indicates "lean" and changes state accordingly, whereafter the proportion of fuel is gradually increased until the sensor indicates "rich" and changes state again: thus the engine continuously cycles between rich and lean running conditions.

One way which we have found satisfactory for achieving this control is by controlling the length of the actuating pulses supplied to the fuel injectors of the engine, in the following manner. Thus, the injector pulse length is modified according to the difference between a stored control value FBPOS and a reference value: the stored control value is increased in steps (if the oxygen sensor indicates a lean condition) to increase the injector pulse length in corresponding steps, until the oxygen sensor changes states, indicating a rich running condition; then the stored control value FBPOS is reduced in steps to correspondingly reduce the injector pulse length, until the oxygen sensor changes state again. At each change in state of the sensor, the first step-change made to the stored FBPOS value is relatively large This process continues, causing the required continuous cycling between rich and lean running conditions.

The system described above serves generally to maintain the pollutants emitted from the exhaust at satisfactorily low levels. However, certain driving conditions and/or particular vehicles can nevertheless lead to unsatisfactory exhaust emissions.

We have now found that such unsatisfactory levels of exhaust emissions can be cured by controlling the changes made to the stored control value FBPOS so that in turn a control is exercised over the relative durations for which the engine is alternately under its "rich" and "lean" running conditions (i.e. a control is exercised over the mark/space ratio of the output signal from the oxygen sensor).

In accordance with this invention, there is provided an electronic control system for an internal combustion engine, comprising a sensor for disposing in the engine exhaust stream and arranged to provide an indicating signal as to whether the engine is running rich and lean, a central control unit storing a control value FBPOS and responsive to said indicating signal to increment or decrement said stored control value according to whether that signal indicates the engine is running leans or rich, and an output from said control unit for providing an actuating signal for controlling the amount of fuel delivered to the engine, the control unit being arranged to control said actuating signal in accordance with the actual control value FBPOS, and the control unit being further arranged to monitor the relative durations for which said indicating signal indicates that the engine is alternately under its rich and lean running conditions and exercise a compensating control over said stored control value so as to tend to maintain said relative durations at an optimum.

The compensating control exercised over the stored control value FBPOS preferably comprises varying the magnitude of the usual step-changes. Preferably this variation is effected to the magnitude of the relatively-large first step-change in the control value which is made at each change in state of the sensor disposed in the engine exhaust stream: the variation may be effected to the first step-change A LUMP occuring as the sensor changes from "rich" to "lean" indications, or to the first step-change S LUMP occuring as the sensor changes from "lean" to "rich" indications, or variations may be effected to both A LUMP and S LUMP.

By maintaining the mark/space ratio of the sensor output signal at an optimum, we have found that unacceptable exhaust emissions, which might otherwise occur under some conditions, are avoided effectively. The optimum mark/space ratio may be a fixed value stored permanently in a memory of the control system, or it may be a value determined in use of the engine or vehicle to which the engine is fitted, and updated accordingly.

An embodiment of this invention will now be described by way of example only and with reference to the accompanying drawings, in which:

FIG. 1 is a schematic block diagram of an electronic control system used with an internal combustion engine;

FIG. 2 is a diagram to show typical changes in level of an output signal derived from an oxygen sensor disposed in the exhaust system from the engine;

FIG. 3 is a diagram to show corresponding cycling of the control value FBPOS;

FIG. 4 is a diagram to show a typical relationship between the fuelling shift and the mark/space ratio of the oxygen sensor output signal shown in FIG. 2;

Figure 5:
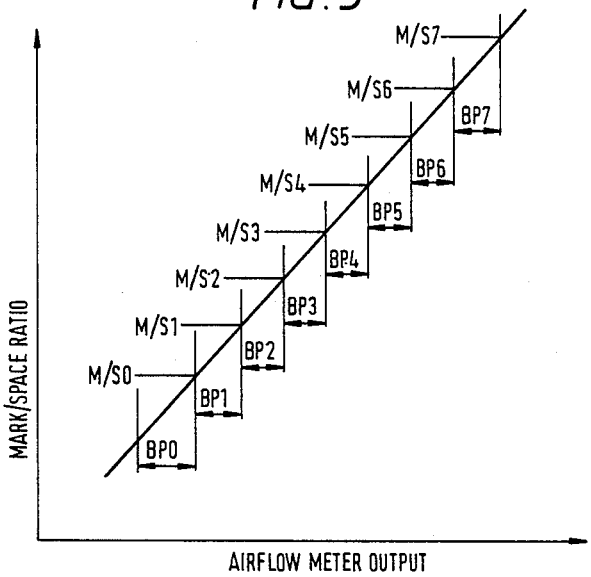
FIG. 5 is a diagram illustrating different values to be selected for the optimum mark/space ratio of the oxygen sensor output signal, depending upon variations in the output of an airflow meter of the system.

Referring to FIG. 1, there is shown an internal combustion engine 10 to be controlled. Air passes to the engine through an airflow meter 12 and a throttle 14 and then via an inlet manifold diagrammatically shown at 16. The exhaust is carried through a duct 18 in which is disposed an oxygen sensor 20 and a catalyst 22. Fuel is supplied to the engine under constant pressure through a feed pipe 24 and injectors 26 which serve to inject the fuel into the inlet manifold 16.

The engine is provided with an electronic control system which is shown diagrammatically and comprises a microprocessor-based digital control unit 30. An output 32 supplies pulses to actuating solenoids of the fuel injectors 26 and the length or duration of these pulses is determined by the control system, in accordance with its various inputs, so as to correspondingly control the length of the intermittent periods for which the respective injectors are open. The control system has an input 34 receiving an output signal from the oxygen sensor 20, an input 36 derived from the engine and indicating engine speed, an input 38 from the airflow meter 12 indicating the air flow-rate and thus representing the engine load, an input 40 from the throttle to indicate the throttle position, an input 42 from the engine cooling system to indicate the engine coolant temperature, and an input 44 from a fuel temperature sensor. The control system includes an ignition system 28 for providing ignition pulses to the engine spark plugs as appropriate over lines 29. A power line for the control system via the ignition switch 47 is shown and also a power line from a standby battery 48 which serves to maintain the volatile memories of the control system whilst the ignition is switched off.

In accordance with known principles, the control unit 30 responds to the inputs 36, 38, 40, 42 representing engine speed, airflow (engine load), throttle position (open or closed) and coolant temperature to determine the fuel requirement and hence the length or duration of the pulses supplied to the fuel injectors 26 from the output 32 of the control unit. However, the control unit modifies the thus-determined pulse length in accordance with the output from the oxygen sensor 34, in the manner which will now be described.

Referring to FIG. 2, the control unit responds to the output from the oxygen sensor 20, which output comprises the signal shown, being of high level if there is a surplus of oxygen in the exhaust and of the low level if there is a deficit of oxygen (indicating that the engine is running on a lean or rich mixture, respectively).

In a memory M1 of the control unit 30, a control value FBPOS is stored, and the control unit 30 modifies the injector pulse length, for controlling the exhaust emission, dependent on the value stored in memory M1. If the stored control value is equal to a reference value FBREF, there is no modification of the pulse length as determined by the other monitored parameters: otherwise, the amount of modification depends on the deviation of the value of FBPOS actually stored in memory M1 from its reference value FBREF. Also, the control unit 30 has an open-loop mode, in which the signal from the oxygen sensor 20 is ineffective and the stored value FBPOS is set to its reference value FBREF: this open-loop mode is adopted whilst the engine is warming to a predetermined temperature at start-up, as indicated at input 42 of the control unit 30.

As shown in FIG. 3, in the closed-loop mode and whilst the oxygen sensor 20 is indicating a lean mixture, the control unit microprocessor MP serves to increase the stored control value FBPOS by steps A STEP at intervals: this has the effect of progressively increasing the injector pulse length and thus progressively enriching the mixture, until the oxygen sensor 20 detects a sufficiently rich mixture that the signal shown in FIG. 2 changes to its low level. In response to this, the control unit microprocessor MP acts to reduce the stored control value FBPOS by a relatively large amount S LUMP, then decreases the stored control value by steps S STEP at intervals: this has the effect of progressively decreasing the injector pulse length and thus progressively weakening the mixture until the oxygen sensor 20 detects a sufficiently weak mixture that the signal shown in FIG. 2 changes back to its high level. In response to this, the control unit microprocessor MP acts to increase the stored control value FBPOS by a relatively large step A LUMP and then increases it again at intervals by the steps A STEP, as previously described.

This sequence applies for the closed-loop mode (in which the oxygen sensor 20 exercises control) and the changes in the stored control value FBPOS can be expressed a follows:

$$\text{FBPOS} = \text{FBPOS} - \text{S STEP (if sensor indicates rich)} \quad (1)$$

$$\text{FBPOS} = \text{FBPOS} + \text{A STEP (if sensor indicates lean)} \quad (2)$$

$$\text{FBPOS} = \text{FBPOS} - \text{S LUMP (change: lean to rich)} \quad (3)$$

$$\text{FBPOS} = \text{FBPOS} + \text{A LUMP (change: rich to lean)} \quad (4)$$

A STEP, S STEP, A LUMP and S LUMP are application dependent constants and the rate of update of the stored control value FBPOS may be N times per second or N times per engine revolution, again depending upon the application (e.g. type and size of engine).

The stored control value FBPOS thus continuously cycles in the manner shown in FIG. 3 so that the air/fuel mixture continuously cycles between rich and lean. This ensures correct working of the catalyst 22, which in the example shown is a three-way catalyst which serves to oxidise carbon monoxide and hydrocarbons in the exhaust stream but also to reduce oxides of nitrogen.

In general the control system as described so far operates effectively to maintain the pollutants in the emitted exhaust at acceptably low levels. In addition, the system exercises further control functions, which will now be described, to avoid unacceptable exhaust emissions occurring under certain driving conditions and/or with particular vehicles. Thus, the control unit microprocessor MP monitors the relative durations for which the engine is running rich and lean, i.e. the mark/space ratio of the signal delivered by the oxygen sensor 20 and shown in FIG. 2. The microprocessor then acts to modify the stored control value FBPOS so as to tend to maintain the mark/space ratio of the oxygen sensor output signal at an optimum. This action by the microprocessor upon the stored value FBPOS may comprise varying the step-change A LUMP, or the step-change S LUMP, or both A LUMP and S LUMP. For example, it will be appreciated that if A LUMP is increased, this will shorten the "lean" duration relative to the "rich" duration.

By thus maintaining the mark/space ratio of the oxygen sensor output signal at an optimum, it is found that unacceptable exhaust emissions, which might otherwise occur, are avoided.

The optimum mark/space ratio for the oxygen sensor output signal may be a fixed value permanently stored in a memory M2 of the control unit. Instead, the control system may be arranged to adapt dynamically in respect of the optimum mark/space ratio, deducing an up-dated value for the mark/space ratio as tee engine ages or for a particular vehicle, for example. With reference to FIG. 4, we have found that the optimum mark/space ratio for the oxygen sensor output occurs at a particular value of the fuelling "shift" between the two running conditions: at or near the optimum mark/space ratio, a small change in the fuelling shift produces a large change in the actual mark/space ratio, whereas more distant from the optimum a corresponding change in the fuelling shift produces only a small change in the mark/space ratio. Thus, the control system may be arranged to monitor the effect of changes in the fuelling shift upon the mark/space ratio of the oxygen sensor output signal, and from this determine the optimum mark/space ratio this is then used to update memory M2. This procedure may moreover be employed as a mapping aid and assist the unit to map itself in respect of mapped values stored in a memory M3 (which mapped values in part determine the injector pulse length and depend upon both the sensed engine speed and load).

Referring to FIGS. 1 and 5, the airflow meter 12 provides an output signal representing the engine load. The control unit microprocessor MP preferably determined in which of a plurality (e.g. 8) of ranges BP0–BP7 the output signal from the airflow meter lies. Then one of a number of optimum values of the mark/space ratio for the oxygen sensor output signal is determined, depending on range BP0–BP7 in which the airflow meter output lies. Thus, a mark/space ratio M/S0 is selected if the output of the airflow meter 12 lies within the range BP0, for example. The microprocessor then functions in a manner tending to maintain the mark/space ratio of the oxygen sensor output signal at the selected optimum value e.g. M/S0.

Figure 6:
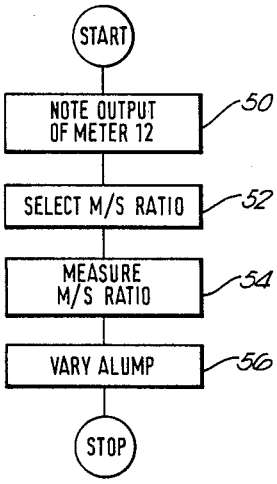
FIG. 6 is a flow diagram of a sub-routine of the operating program of a microprocessor of the control system.

These functions of the control unit microprocessor MP are illustrated in the sub-routine of its operating program, as shown in FIG. 6. In this sub-routine, at step 50 the microprocessor MP notes the value of the output from the airflow meter 12, representing the engine load. At step 52 the required mark/space ratio for the oxygen sensor output is determined (e.g. M/S0, M/S1 . . . M/S7) according to whether the output from the airflow meter 12 lies in range BP0, BP1 . . . BP7. At step 54 the microprocessor MP measures the actually-occuring mark/space ratio of the oxygen sensor output signal. Then at step 56 the microprocessor MP changes the step-change A LUMP according to the deviation of the measured mark/space ratio from the selected optimum value, so as to tend to maintain the actual mark/space ratio at the selected optimum value.

What is claimed is:

1. An electronic control system for an internal combustion engine, said engine including an exhaust stream, said control system comprising:

a sensor means responsive to the engine exhaust stream for providing a first indicating signal when the engine is running rich and a second indicating signal when the engine is running lean; and a central control unit having:

means for storing a control value;

means responsive to said first and second indicating signals for respectively incrementing and decrementing said stored control value;

output means responsive to said storing means for providing an actuating signal for controlling the amount of fuel delivered to said engine;

means for monitoring the relative durations of the first and second indicating signals; and compensating control means responsive to said monitoring means for exercising a compensating control over said stored control value so as to tend to maintain said relative durations at an optimum ratio.

2. An electronic control system as claimed in claim 1, in which said central control unit means comprises means responsive to a change in said sensor means between its first and second indicating signals to effect a step-change in the stored control value, and in which said compensating control means is responsive to said monitoring means to vary said step-change.

3. An electronic control system as claimed in claim 1, in which said central control unit means comprises means storing a fixed value of an optimum mark/space ratio for said first and second indicating signals and in which said compensating control means is responsive to said monitoring means and said stored fixed value to control said stored control value so as to tend to maintain said mark/space ratio at said stored fixed value.

4. An electronic control unit as claimed in claim 3, in which said central control unit means comprises means responsive to engine performance to deduce an updated value for said optimum mark/space ratio value and to replace the stored mark/space ratio value with the updated value.

5. An electronic control system as claimed in claim 3, comprising means responsive to engine load to select an optimum mark/space ratio value.

* * * * *